US010856630B1

(12) United States Patent
Hu

(10) Patent No.: US 10,856,630 B1
(45) Date of Patent: Dec. 8, 2020

(54) AUTOMATIC TELESCOPIC POLE

(71) Applicant: NINGHAI XINGDA LEISURE PRODUCTS CO., LTD., Zhejiang (CN)

(72) Inventor: Jinxue Hu, Zhejiang (CN)

(73) Assignee: NINGHAI XINGDA LEISURE PRODUCTS CO., LTD., Zhejiang (CN)

( * ) Notice: Subject to any disclaimer, the term of this patent is extended or adjusted under 35 U.S.C. 154(b) by 0 days.

(21) Appl. No.: 16/727,950

(22) Filed: Dec. 27, 2019

(30) Foreign Application Priority Data

Aug. 21, 2019 (CN) ..... 2019 1 0772994

(51) Int. Cl.
*A45B 9/00* (2006.01)
*A45B 9/02* (2006.01)
*A63C 11/22* (2006.01)

(52) U.S. Cl.
CPC ..... *A45B 9/00* (2013.01); *A45B 9/02* (2013.01); *A63C 11/221* (2013.01); *A63C 11/222* (2013.01); *A45B 2009/007* (2013.01); *A45B 2200/05* (2013.01); *A45B 2200/055* (2013.01)

(58) Field of Classification Search
CPC ..... A63C 11/221; A63C 11/222; A45B 2009/007; A45B 2200/05; A45B 2200/055
USPC ..... 135/25.4, 75; 280/819, 821, 823
See application file for complete search history.

(56) References Cited

U.S. PATENT DOCUMENTS 4,448,442 A * 5/1984 Weber-Henning ..... A63C 11/221 280/823
4,456,285 A * 6/1984 Weber-Henning ..... A63C 11/222 280/823
5,470,108 A * 11/1995 Goode ..... A63C 11/222 135/75
6,264,242 B1 * 7/2001 Lenhart ..... A45B 9/02 280/821
10,064,463 B2 * 9/2018 Kreis ..... A63C 11/227

FOREIGN PATENT DOCUMENTS

CN 110548262 A * 12/2019
EP 1409878 11/2006
EP 1274946 6/2007
FR 2845008 A1 * 4/2004
FR 3080750 A1 * 11/2019 ..... A45B 9/02
WO WO-2019211124 A1 * 11/2019 ..... A63C 1/222

* cited by examiner

*Primary Examiner* — Robert Canfield
(74) *Attorney, Agent, or Firm* — JCIP Global Inc.

(57) ABSTRACT

The present invention discloses an automatic telescopic pole, which comprises a first pole section having an upper end and a lower end; a second pole section telescopically disposed inside the first pole section; a handle disposed on the upper end of the first pole section; an elastic member disposed between the second pole section and the first pole section; a clasp-type telescopic locking device disposed between the second pole section and the first pole section; a driving rod having an upper end and a lower end, and disposed in the clasp-type telescopic locking device along a longitudinal direction of the first pole section; wherein, a button mechanism having a button is disposed on the handle; and, a lock catch is slideably disposed on the handle and in front of the button mechanism.

18 Claims, 7 Drawing Sheets

AUTOMATIC TELESCOPIC POLE

CROSS-REFERENCE TO RELATED APPLICATION

This application claims the priority benefit of China Application serial no. 201910772994.1, filed on Aug. 21, 2019. The entirety of the above-mentioned application is incorporated here by this reference and made a part of this specification.

BACKGROUND

Technical Field

The present invention relates to the technical field of poles and in particular to an automatic telescopic pole.

Description of Related Art

The existing poles, such as mountaineering poles and ski poles, are mainly used to aid walking and provide support. The conventional poles are usually integral poles that are long, large in size, and inconvenient for storage or transport. In view of those disadvantages, many telescopic poles have been proposed. A telescopic pole generally includes a main tube and an extended tube, the extension/retraction of which is positioned by an extension/retraction positioning device to reduce the size. At present, there have been automatic telescopic poles. For example, Patent EP1274946B1, entitled "device for locking two elongated elements", discloses a locking structure used between two pole sections of an automatic telescopic pole. The locking structure is a clasp-type telescopic locking device. The telescopic locking device is controlled, by a driving rod, in a locked state or in an unlocked state in which the second pole section is enabled to or not to automatically pop up from the first pole section in the presence of an elastic member, in order to realize the automatic extension/retraction of the pole. However, this patent mainly focused on the clasp-type telescopic locking device, without any description about how the driving rod drives or locks safely. Although such a structure can realize the automatic extension/retraction of the pole, it is complex; and there is a risk of unexpected automatic extension/retraction of the pole due to accident operation, and such unexpected automatic extension/retraction may even endanger the users' personal safety in severe cases. Furthermore, the existing structure is complex, without any shock absorbing structure, resulting in poor user experience.

As another example, Patent EP1409878B1 also discloses a similar clasp-type telescopic locking device used between two pole sections of an automatic telescopic pole. In this patent, the oscillating ring mechanism is improved and some structures are simplified. However, due to the use of a driving rod, there is still a risk of unexpected automatic extension/retraction of the pole due to accident operation. Therefore, further improvements are desired.

SUMMARY

A technical problem to be solved in the present invention is to provide, in view of the problems in the prior art, an automatic telescopic pole which is simple and rational in structure and is safe and reliable to use, by which the risk of unexpected automatic extension/retraction of the pole due to accident operation can be eliminated and the safety and reliability when in use can be improved.

In order to solve the first technical problem, the automatic telescopic pole comprises a first pole section, a second pole section, a handle, an elastic member, a clasp-type telescopic locking device and a driving rod. The first pole section has an upper end and a lower end. The second pole section is telescopically disposed inside the first pole section. The handle is disposed on the upper end of the first pole section. The elastic member keeps the second pole section in a trend of extending outward, and is disposed between the second pole section and the first pole section. The clasp-type telescopic locking device has a clasp used for locking the second pole section, and is disposed between the second pole section and the first pole section. The driving rod has an upper end and a lower end, is used for driving the clasp to oscillate, and is disposed in the clasp-type telescopic locking device along a longitudinal direction of the first pole section. A button mechanism which has a button and is used for pressing against the upper end of the driving rod to unlock the telescopic locking device, is disposed on the handle. A lock catch for locking the button is slideably disposed on the handle and in front of the button mechanism.

Preferably, the handle comprises a handle body and a cover; the button of the button mechanism having a front end and a rear end is disposed on the top of the handle body; the front end of the button is hinged with a top end of the handle body; the cover has an opening at a rear portion of the cover, the rear end of the button is exposed from the opening of the cover; the sliding groove is communicated with the opening of the cover for receiving the lock catch which can slide along the sliding groove; the button has a pressing recess disposed at a middle of a top portion of the button and matching with the lock catch for preventing the button from popping upward; a third spring surrounds around the driving rod and resists against the button to keep the button in a trend of popping upward; a middle of a bottom portion of the button is resisted against the driving rod; and the driving rod moves downward when the button is pressed down, to make the clasp-type telescopic locking device to be unlocked.

Preferably, an upper opening is formed at an upper end of the handle body, a connecting ear is arranged at a front end of the upper opening, and a pair of connecting holes is formed on the connecting ear; an axle hole is transversely formed at the front end of the button; a connecting pin passes through the pair of connecting holes and the axle hole to rotatably connect the button and the handle body together; a pressing portion, which is protruded from the cover, is formed in the rear portion of the button; a front side of an upper end of the pressing portion extends forward to form the pressing recess in which the lock catch is inserted for locking; and, a rear end of the pressing portion is sheathed on a rear side of the cover in such a way that the rear end is oscillatable up and down.

Preferably, the handle comprises a handle body with an upper end and a lower end, and a cover with an upper end and a lower end; the button mechanism is designed in such a way that the button is disposed on the upper end of the handle body; the button is inserted into the handle body in such a way that the button is movable up and down; an opening, from which the button is protruded, is formed on the upper end of the cover; a positioning slide rail, in which the lock catch is disposed and slidable therein, is arranged at a front end of the opening of the cover; a pressing portion, fitted with the lock catch for locking, is formed in a middle of an upper end of the button; a third spring, which is resisted against the button to keep the button always in a trend of popping up outward, is sheathed on the driving rod; the bottom of the button is resisted against the driving rod;

and, the driving rod moves downward when the button is pressed down, to drive the clasp-type telescopic locking device to open.

Preferably, a pair of guide and limiting holes are formed on two sides of the button in the longitudinal direction, and pins passes through the pair of guide and limiting holes and then fixed on the handle body.

Preferably, the lock catch is a bar structure fitted with the positioning slide rail on the cover; the lock catch is disposed on the positioning slide rail, with a front end of the lock catch being inserted into and clamped in the cover by shift lock fitting, and a rear end of the lock catch extending downward and backward to form a locking portion fitted with the pressing portion on the button for locking.

Preferably, a shift lock trough is concavely and transversely formed on a front side of an upper end surface of the lock catch, a corresponding shift lock rib is convexly and transversely formed on an inner wall of the cover, and a jagged oblique bump, which is convenient for pushing by a hand, is formed in a middle of the upper end surface of the lock catch.

Preferably, the clasp-type telescopic locking device comprises a connecting sleeve, an oscillating ring and a locking clasp; the connecting sleeve is fixedly sheathed on an outer side of the lower end of the first pole section; the oscillating ring is disposed, by a connecting pin, in the connecting sleeve at a position below the first pole section, in such a way that the oscillating ring is oscillatable therein; the locking clasp has an upper clasp and a lower clasp; the second pole section is inserted in the first pole section by passing through the connecting sleeve, the lower clasp, the oscillating ring and the upper clasp, and the second pole section is locked with and fixed to the connecting sleeve by the locking clasp; and the elastic member is a fourth spring which keeps the second pole section always in a trend of popping up outward.

Preferably, an annular cavity has an upper end and a lower end, in which the oscillating ring, the upper clasp and the lower clasp are received and is oscillatable therein, is formed in a middle of an inner wall of the connecting sleeve; a first slot, in which a front end of the upper clasp is inserted and which tilts backward and downward, is formed on a front side of the upper end of the annular cavity; a second slot, in which a rear end of the lower clasp is inserted and which tilts forward and upward, is formed on a rear end of the annular cavity; the oscillating ring is rotatably disposed between the first slot and the second slot; a first spring, which is resisted against a rear side of the upper clasp, is longitudinally disposed in the connecting sleeve at a position over the rear side of the upper clasp; a second spring, which is resisted against a front side of a lower end of the lower clasp, is longitudinally disposed at a position below the front side of the lower clasp; the upper clasp and the lower clasp are obliquely resisted against one side of the oscillating ring respectively by the first spring and the second spring, and an inner wall of each of the upper clasp and the lower clasp is locked with and fixed to an outer wall of the second pole section; the driving rod is disposed inside the first pole section, and the lower end of the driving rod is resisted against a front side of an upper end of the oscillating ring by passing through the front side of the upper clasp or directly; the driving rod moves downward when the button is pressed down, to drive a front side of the oscillating ring to oscillate downward, the upper clasp and the lower clasp become straight against an effect of the first spring and the second spring due to the oscillating ring, to release the locking of the second pole section.

Preferably, the lower clasp is configured as two lower clasps superimposed together.

Preferably, a circular channel through which the second pole section passes and a circular hole through which the driving rod passes run through the first pole section; a guide hole corresponding to the circular hole is formed in the handle; and, the upper end of the driving rod resists against the button by passing through the handle.

Preferably, a shock absorbing spring is longitudinally disposed in the connecting sleeve at a position over a front side of the upper clasp, and the shock absorbing spring is disposed over the upper clasp and in a transition space between the circular channel and the circular hole and is fitted with a guide and limiting block on the second pole section.

Preferably, the connecting sleeve is divided into a left connecting sleeve and a right connecting sleeve, which are fixedly clamped, by an upper jacket and a lower jacket, on the first pole section after being folded together at the lower end of the first pole section.

Preferably, two positioning holes are axially formed on left and right sides of the lower end of the first pole section; corresponding two positioning blocks are convexly disposed on inner walls of upper portions of the left connecting sleeve and the right connecting sleeve; the left connecting sleeve and the right connecting sleeve are folded together and then positioned at the lower end of the first pole section by fitting of the positioning blocks with the positioning holes and then are fixedly clamped by the upper jacket and the lower jacket.

Preferably, the upper jacket is a jacket having an open side corresponding to an upper portion of the connecting sleeve, and a transition and connection part of the first pole section is also a guide portion fitted with the upper jacket.

Preferably, a shock absorbing spring, which is fitted with a guide and limiting block on the second pole section, is longitudinally disposed in the connecting sleeve at a position over a front side of the upper clasp; and, a positioning slot, in which a lower end of the shock absorbing spring is inserted, is formed in an upper portion of an annular cavity after the left connecting sleeve and the right connecting sleeve are folded together.

Preferably, a circular channel through which the second pole section passes and a circular hole through which the driving rod passes run through the first pole section; the shock absorbing spring is inserted in the positioning slot and in a transition and connection portion between the circular channel and the circular hole; the guide and limiting block is convexly disposed on a side of a stopper arranged at the upper end of the second pole section, and corresponds to the shock absorbing spring.

Preferably, a lower end of the handle body is sheathed on the first pole section and fixed to the first pole section by a handle sheath; a gap, in which a wrist strap is inserted, is formed between a rear side of the handle body and the cover; and, a screw passes through the cover and the wrist strap and screws into the handle body to fix the wrist strap.

Compared with the prior art, the present invention has the following advantages: a lock catch is additionally disposed on the handle, by which the button can be locked conveniently to avoid the unexpected automatic extension/retraction of the pole when accidently pressing down the button; and the structure is simple and rational, and it is easy for manufacturing; only the integral oscillating ring and the upper and lower clasps are disposed in the locking device, and there are two lower clasps, therefore the locking is more firm and stable and it is convenient for assembling; the additional arrangement of the shock absorbing spring makes the extension/retraction of the pole more stable and reliable; the connecting sleeve is divided into a left connecting sleeve and a right connecting sleeve, which are folded together by an upper jacket and a lower jacket, and this design is convenient for assembling and the connection is firm and stable; the automatic telescopic pole of the present invention is simple in structure, easy to use, and low in cost; in addition to automatic extension/retraction, it is convenient for transport or storage; since the button can be locked, it is safer and more reliable to use; and the automatic telescopic pole is ideal for use as a mountaineering pole, a ski pole, a hiking pole, etc.

To make the aforementioned more comprehensible, several embodiments accompanied with drawings are described in detail as follows.

BRIEF DESCRIPTION OF THE DRAWINGS

The accompanying drawings are included to provide a further understanding of the disclosure, and are incorporated in and constitute a part of this specification. The drawings illustrate exemplary embodiments of the disclosure and, together with the description, serve to explain the principles of the disclosure.

DESCRIPTION OF THE EMBODIMENTS

Figure 1:
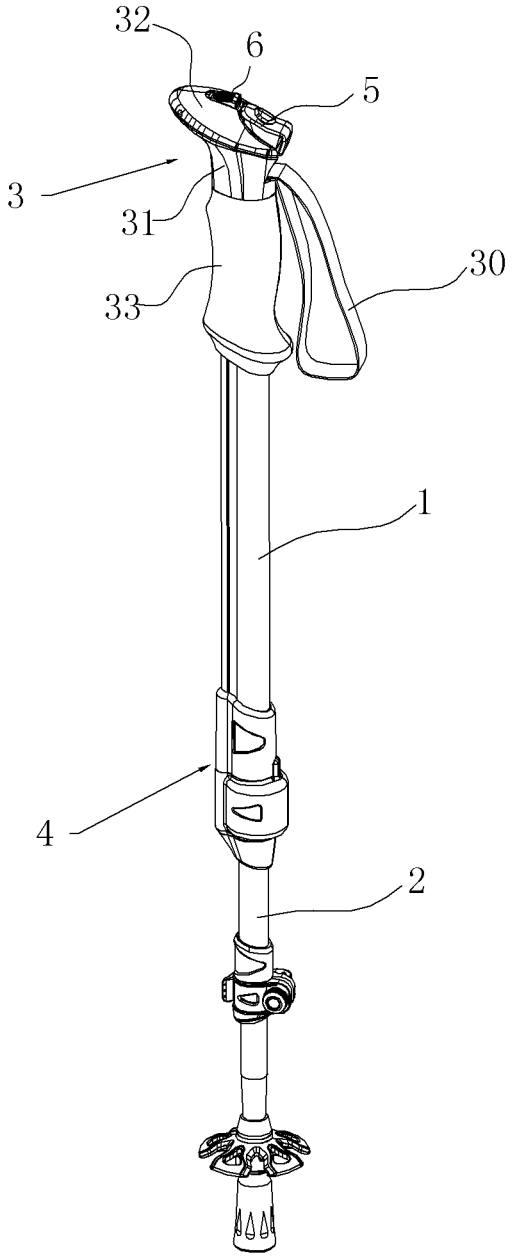
FIG. 1 is a perspective view of an automatic telescopic pole according to Embodiment 1 of the present invention.
Figure 2:
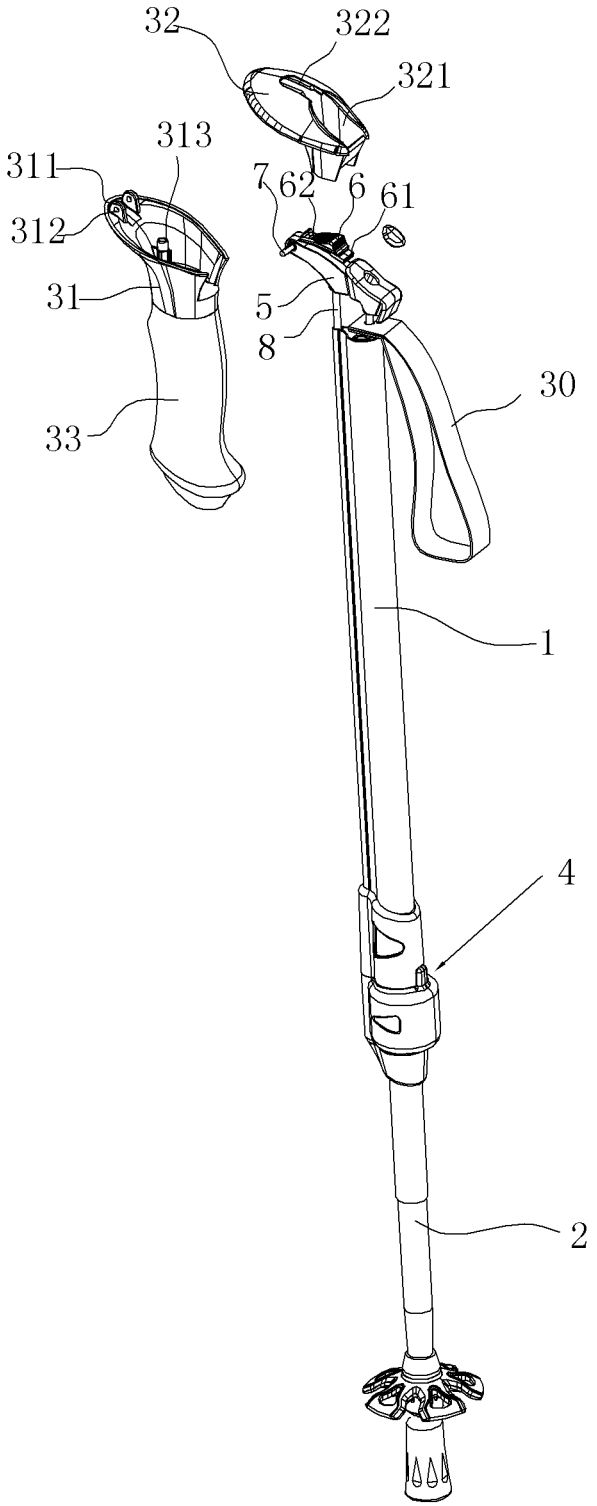
FIG. 2 is a perspective view of the automatic telescopic pole according to Embodiment 1 of the present invention when the handle is opened.
Figure 3:
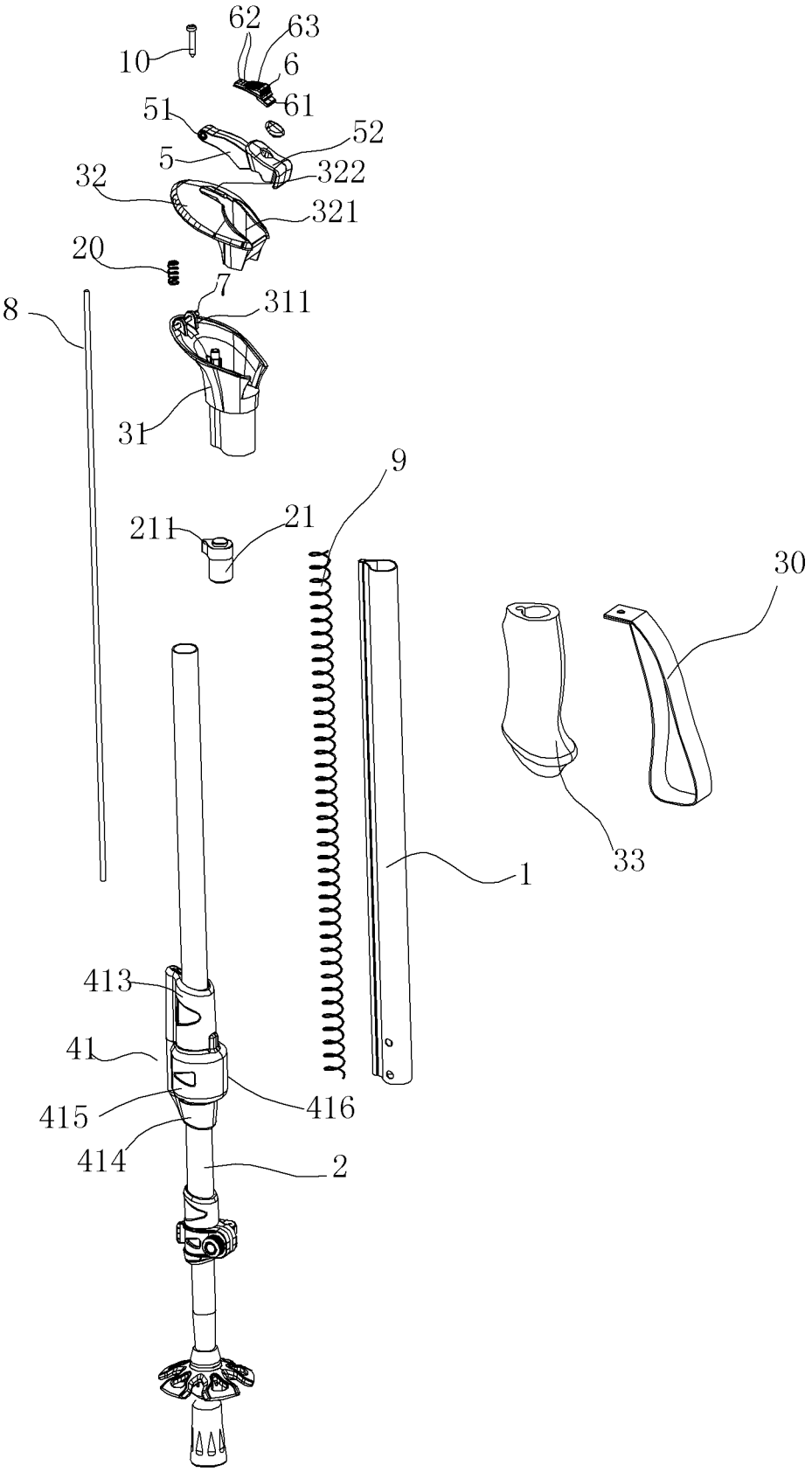
FIG. 3 is an exploded view of FIG. 1.
Figure 4:
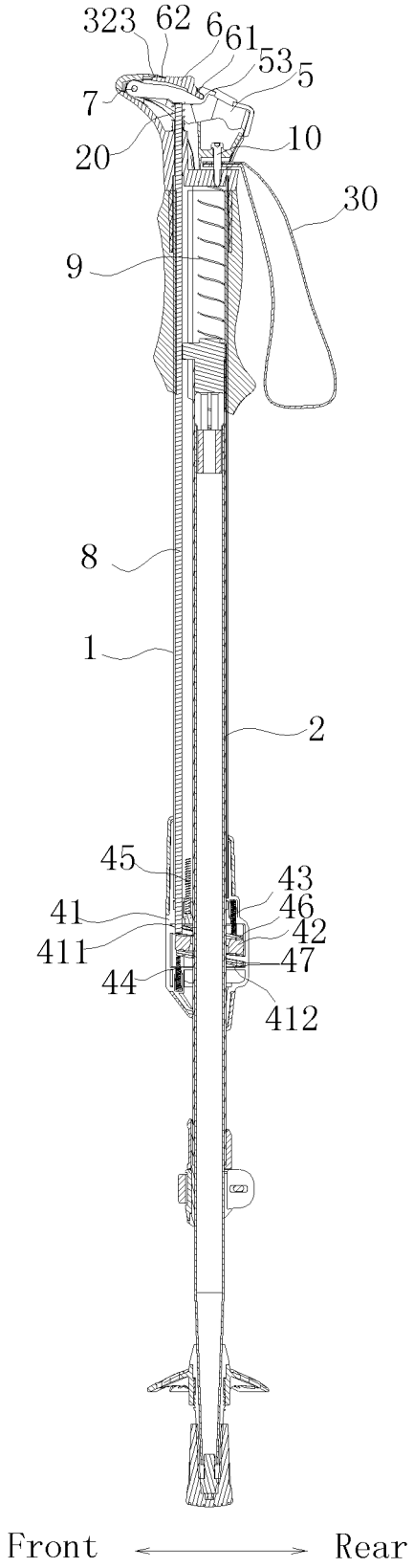
FIG. 4 is a sectional structure view of the automatic telescopic pole according to Embodiment 1 of the present invention, when a button is locked.
Figure 5:
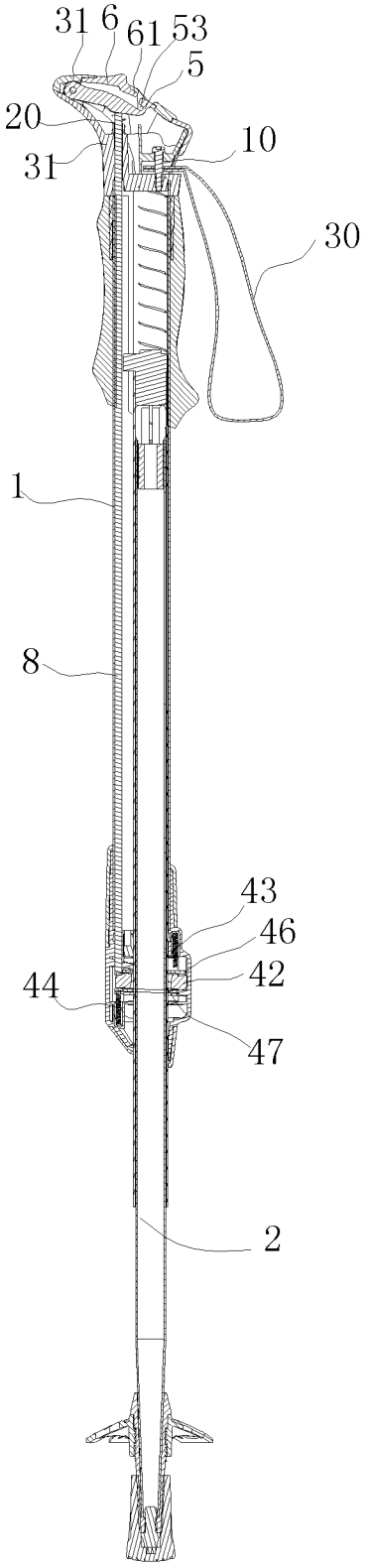
FIG. 5 is a sectional structure view of the automatic telescopic pole according to Embodiment 1 of the present invention, when the button is unlocked.

To enable a further understanding of the present invention content of the invention herein, refer to the detailed description of the invention and the accompanying drawings below:

Embodiment 1

FIGS. 1-5 and FIG. 9 show an embodiment of the automatic telescopic pole. The automatic telescopic pole comprises a first pole section 1 with an upper end and a lower end, a second pole section 2, a third pole section, a handle 3, as well as a telescoping mechanism and a clasp-type telescopic locking device 4. The third pole section is telescopically disposed inside the second pole section 2, and the third pole section is locked by a locking component disposed on a lower end of the second pole section 2. This is common sense. The handle 3 is disposed on the upper end of the first pole section 1. The second pole section 2 is telescopically disposed inside the first pole section 1. An elastic member, which keeps the second pole section 2 in a trend of extending outward, is disposed between the second pole section 2 and the first pole section 1. The first pole section 1 and the second pole section 2 are locked and fixed by the clasp-type telescopic locking device 4. A driving rod 8 with an upper end and a lower end, used for driving the clasp to oscillate, is disposed in the clasp-type telescopic locking device 4 along a longitudinal direction of the first pole section 1. A button mechanism having a button 5, which is used for pressing against the upper end of the driving rod 8 to unlock the telescopic locking device, is disposed on the handle 3. A lock catch 6, which can lock the button 5, is slideably disposed on the handle 3 and in front of the button mechanism. The handle 3 mainly comprises of a handle body 31, a cover 32 and a handle sheath 33, which can be fixedly connected by pins. The lower end of the handle body 31 is sheathed on the first pole section 1 and fixed to the first pole section 1 by the handle sheath 33. The button 5 of the button mechanism having a front end and a rear end is disposed on the top of the handle body 31. The front end of the button 5 is hinged with the handle body 31. The cover 32 has an opening 321 disposed at a rear portion of the cover 32, and a sliding groove 322 disposed at a middle portion of the cover 32. the rear end of the button 5 is exposed from the opening 321. The sliding groove 322 communicated with the opening 321, for receiving the lock catch 6 which can slide along the sliding groove 322. A pressing portion 53, fitted with the lock catch 6 for locking, is formed in the middle of the upper end of the button 5. The button 5 has a pressing recess 53 disposed at the middle of the top of the button 5 and matching with the lock catch 6 for preventing the button 5 from popping upward. The middle of a bottom portion of the button 5 is resisted against the driving rod 8. A third spring 20 surrounding around the driving rod 8, resists against the button 5 to keep the button 5 in a trend of popping upward. The driving rod 8 moves downward when the button 5 is pressed down, to make the clasp-type telescopic locking device 4 to be unlocked.

The specific structure will be described below. An upper opening is formed at the upper end of the handle body 31. A connecting ear 311 is arranged at a front end of the upper opening, and a pair of connecting holes 312 is formed on the connecting ear 311. An axle hole 51 is transversely formed at the front end of the button 5 in the button mechanism. A connecting pin 7 passes through the pair of connecting holes 312 and the axle hole 51 to rotatably connect the button 5 and the handle body 31 together. A pressing portion 52, which is protruded from the cover 32, is formed in a rear portion of the button 5. A front side of an upper end of the pressing portion 52 extends forward to form a pressing portion 53 in which the lock catch is inserted for locking. A rear end of the pressing portion 52 is sheathed on a rear side of the cover 32 in such a way that the rear end of the pressing recess 53 can move up and down. The upper end of the driving rod 8 is usually disposed on the middle of the bottom of the button 5. With this arrangement, the leverage effect is obtained, the thrust is increased, and the flexibility of the driving rod during its operation is improved. The lock catch 6 is a bar structure fitted with the positioning slide groove 322 on the cover 32. The lock catch 6 is disposed on the positioning slide groove 322. A shift lock trough 62 is concavely and transversely formed on a front side of an upper end surface of the lock catch 6, and a corresponding shift lock rib 323 is convexly and transversely formed on an inner wall of the cover 32. A front end of the lock catch 6 is inserted into and clamped in the cover 32 by shift lock fitting, and a rear end of the lock catch 6 extends downward and backward to form a locking portion 61 fitted with the pressing portion 53 on the button 5 for locking. A jagged oblique bump 63, which is convenient for pushing by a hand, is formed in the middle of the upper end surface of the lock catch 6.

The telescoping mechanism comprises a fourth spring 9 which is disposed inside the first pole section 1 to keep the second pole section 2 always in a trend of popping up outward. The fourth spring 9 can be provided with a spring bag to reduce both noise and friction with the wall. The principle of the telescoping mechanism is the same as the conventional telescoping mechanisms and will not be repeated herein.

The clasp-type telescopic locking device 4 comprises a connecting sleeve 41, an oscillating ring 42, a locking clasp, as well as a first spring 43 and a second spring 44. The connecting sleeve 41 is fixedly sheathed on an outer side of a lower end of the first pole section 1. The oscillating ring 42 is disposed, by a connecting pin, in the connecting sleeve 41 at a position below the first pole section 1, in such a way that the oscillating ring 42 can oscillate therein. The locking clasp has an upper clasp 46 and a lower clasp 47. The second pole section 2 is inserted in the first pole section 1 by passing through the connecting sleeve 41, the lower clasp 47, the oscillating ring 42 and the upper clasp 46, and locked with and fixed to the connecting sleeve 41 by the upper clasp 46 and the lower clasp 47. An annular cavity with an upper end and a lower end, in which the oscillating ring 42, the upper clasp 46 and the lower clasp 47 are received and can oscillate therein, is formed in the middle of an inner wall of the connecting sleeve 41. A first slot 411, in which a front end of the upper clasp 46 is inserted and which tilts backward and downward, is formed on a front side of the upper end of the annular cavity. When viewed from the cross section, a top surface of the first slot 411 is planar, and a bottom surface of the first slot 411 is a surface which is gradually inclined backward and downward. A second slot 412, in which a rear end of the lower clasp 47 is inserted and which tilts forward and upward, and is formed on a rear side of a lower end of the annular cavity. When viewed from the cross section, a bottom surface of the second slot 412 is planar, and a top surface of the second slot 412 is a surface which is gradually inclined forward and upward. The oscillating ring 42 is disposed between the first slot 411 and the second slot 412. A first spring 43, which is resisted against a rear side of the upper clasp 46, is longitudinally disposed in a spring hole formed in the upper portion 46 of the rear side of the upper clasp 46, so that the rear side of the upper clasp 46 is inclined downward to be resisted against the upper portion of the rear side of the oscillating ring 42. A second spring 44, which is resisted against a front side of a lower end of the lower clasp 47, is longitudinally disposed in a spring hole formed in the lower portion of the front side of the lower clasp 47, so that the front side of the lower clasp 47 is inclined upward to be resisted against the lower portion of the front side of the oscillating ring 42. The inner walls of each of the upper clasp 46 and the lower clasp 47 is locked with and fixed to an outer wall of the second pole section 2, so that the second pole section 2 cannot automatically extend and pop up. In order to increase the degree of locking, there are two low clasps 47. The driving rod 8 is disposed inside the first pole section 1, and the lower end of the driving rod 8 is resisted against the front side of the upper end of the oscillating ring 42 by passing through the front side of the upper clasp 46. The driving rod 8 moves downward when the button 5 is pressed down, to drive the front side of the oscillating ring 42 to oscillate downward by using its pin, until a bottom surface of the lower clasp 47 clings to the flat bottom surface of the second slot 412. Then, the lower clasp 47 is turned in a positive direction and forms a clearance between the outer wall of the second pole section 2. Similarly, by the oscillation of the oscillating ring 42, the rear side of the oscillating ring 42 is resisted against a bottom surface of the rear side of the upper clasp 46, so that the rear side of the upper clasp 46 is rotated upward, until a top surface of the upper clasp 46 clings to the flat top surface of the first slot 411. Then, the upper clasp 46 is turned in the positive direction and forms a clearance between the outer wall of the second pole section 2. In this way, the upper clasp 46 and the lower clasp 47 release the locking of the second pole section 2 against the effect of the first spring 43 and the second spring 44 due to the oscillating ring 42. The second pole section 2 can automatically pop up under the effect of the fourth spring 9. To improve the stability when in use and to reduce noise, a shock absorbing spring 45 is longitudinally disposed in the connecting sleeve 41, at a position over the front side of the upper clasp 46, in a transition space between the second pole section 2 and the driving rod 8. The shock absorbing spring 45 can be fitted with a guide and limiting block 211 on the second pole section 2. Usually, the guide and limiting block 211 is disposed on a side of a stopper 21 on the second pole section 2. To be convenient to mount the connecting sleeve 41 and built-in parts such as the oscillating ring 42, the upper clasp 46, the lower clasp 47, as well as the first spring 43 and the second spring 44, the connecting sleeve 41 is divided into a left connecting sleeve 415 and a right connecting sleeve 416, which are fixed, by an upper jacket 413 and a lower jacket 414, on the first pole section 1 after being folded together at the lower end of the first pole section 1. In contrast, once the button 5 is released, the driving rod 8 returns to its original position due to the third spring 20, the upper clasp 46 and the lower clasp 47 return to their original positions respectively due to the first spring 43 and the second spring 44, the oscillating ring 42 is driven to oscillate in an opposite direction until the bottom surface of the upper clasp 46 clings to the inclined bottom surface of the first slot 411 so that the upper clasp 46 is inclined to be resisted against the second pole section 2, and a top surface of the lower clasp 47 clings to the inclined top surface of the second slot 412 so that the lower clasp 47 is inclined to be resisted against the second pole section 2. In this way, the second pole section 2 is locked again by the upper clasp 46 and the lower clasp 47.

Since the connecting sleeve 41 is of a structure formed by the left connecting sleeve 415 and the right connecting sleeve 416 folded together, two positioning holes 11 are axially formed on left and right sides of the lower end of the first pole section 1, corresponding two positioning blocks 400 are convexly disposed on the inner walls of the upper portions of the left connecting sleeve 415 and the right connecting sleeve 416, and the left connecting sleeve 415 and the right connecting sleeve 416 are folded together and then positioned at the lower end of the first pole section 1 by the fitting of the positioning blocks 400 with the positioning holes 11 and then fixedly clamped on the first pole section 1 by the upper jacket 413 and the lower jacket 414. A shock absorbing spring 45, which is fitted with the guide and limiting block 211 on the second pole section 2, is longitudinally disposed in the connecting sleeve 41 at a position over the front side of the upper clasp 46. A positioning slot 410 for receiving the lower end of the shock absorbing spring 45 is formed in the upper portion of the annular cavity 401 after the left connecting sleeve 415 and the right connecting sleeve 416 are folded together. A circular channel through which the second pole section 2 passes and a circular hole through which the driving rod 8 passes run through the first pole section 1. The circular channel and the circular hole are not absolutely circular, and instead they have openings by which they are communicated with the transition and connection part (i.e., the transition space) conveniently. The shock absorbing spring 45 is inserted in the positioning slot 410 and in the transition and connection portion between the circular channel and the circular hole. Usually, the transition portion or the transition and connection portion is slightly concave on two sides. The guide and limiting block 211 is convexly disposed on a side of a stopper 21 arranged at the upper end of the second pole section 2, corresponding to the shock absorbing spring 45. In this way, when the second pole section 2 pops up downward, the guide and limiting block 211 slides downward and provides a cushioning effect when crashing to the shock absorbing spring 45. The stability of extension of the pole is improved, and the noise is reduced. The upper jacket is an elastic jacket having an open side corresponding to the upper portion of the connecting sleeve 41, and can be made of plastic. The transition and connection portion of the first pole section 1 is also the guide portion fitted with the upper jacket 413. In addition, the upper jacket 413 is formed with a finger hole by which the assembling process is facilitated.

During the mounting, firstly, the left connecting sleeve 415 of the connecting sleeve 41 is fixed at the lower end of the first pole section 1 by the fitting of the positioning block 400 with the positioning hole 11. Then, the oscillating ring 42, the upper clasp 46, the lower clasp 47, the first spring 43, the second spring 44 and the shock absorbing spring 45 are placed in corresponding openings, respectively. The right connecting sleeve 416 is positioned at the lower end of the first pole section 1 by the fitting of the positioning block 400 with the positioning hole 11 to be folded with the left connecting sleeve 415; and then the left connecting sleeve 415 and the right connecting sleeve 46, after being folded together, are fixedly clamped on the first pole section 1 by the upper jacket 413 and the lower jacket 414.

A wrist strap 30 is connected to the handle 3. A gap, in which the wrist strap 30 is inserted, is formed between the rear side of the handle body 31 and the cover 32. A screw 10 passes through the cover 32 and the wrist strap 30 and screws into the handle body 31 to fix the wrist strap 30.

The specific operation will be described below.

When it is necessary to extend the second pole section 2, firstly, the lock latch 6 is moved to release the locking of the button 5, the button 5 is pressed down, the driving rod 8 moves downward to drive the oscillating ring 42 to oscillate, the upper clasp 46 and the lower clasp 47 rotate against the effect of the first spring 43 and the second spring 44 due to the oscillating ring 42, the oscillating ring 42, the upper clasp 46 and the lower clasp 47 enter the planar state from the inclined state, the locking of the second pole section 2 is released, and the second pole section 2 automatically pops up due to the fourth spring 9. The button 5 is released, the driving rod 8 moves upward, and both the upper clasp 46 and the lower clasp 47 rotate in an opposite direction to return to their original positions due to the first spring 43 and the second spring 44 and enter the inclined state to be resisted against the outer wall of the second pole section 2 so that the second pole section 2 is locked.

When not in use, the button 5 is pressed down, the upper clasp 46 and the lower clasp 47 enter the planar state, the locking of the second pole section 2 is released, and the handle 3 is pressed to retract the second pole section 2 inward. When the second pole section 2 is retracted to a proper position, the button 5 is released, the driving rod 8 moves upward under the effect of the third spring, both the upper clasp 46 and the lower clasp 47 rotate in an opposite direction to return to their original positions due to the first spring 43 and the second spring 44 and enter the inclined state so that the second pole section 2 is locked. The lock catch 6 at the upper end of the handle 3 is moved so that the lock catch 6 locks the button 5.

Embodiment 2

Figure 6:
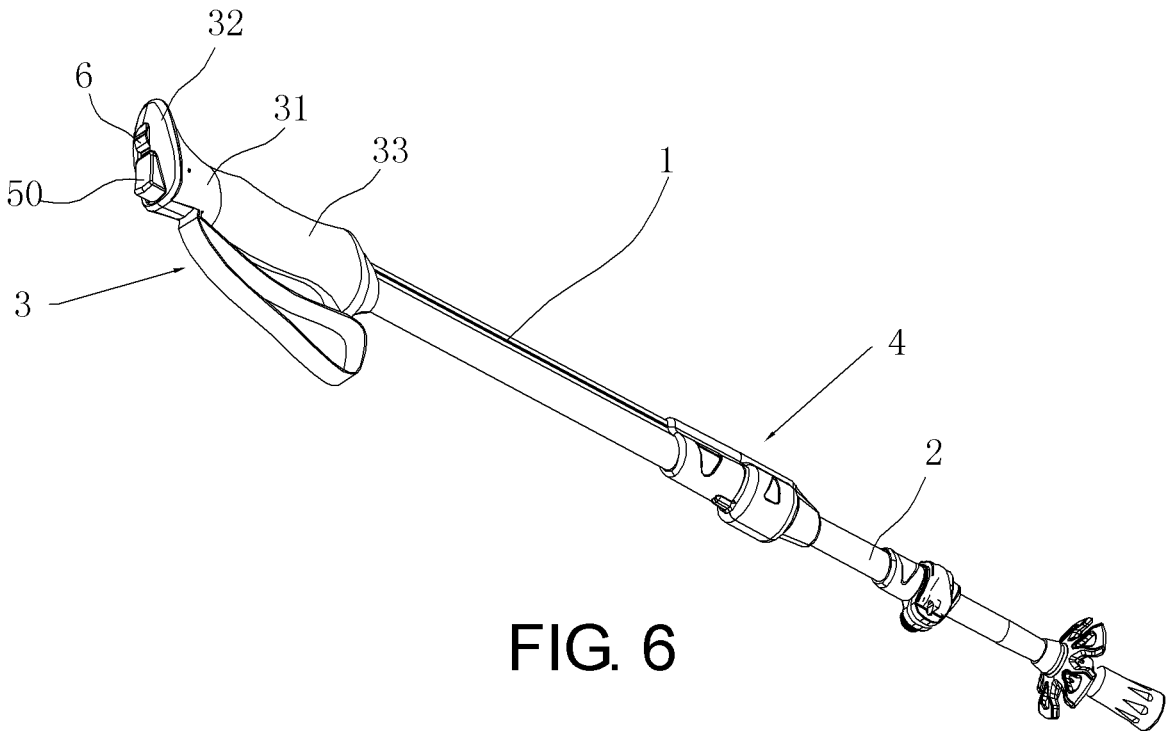
FIG. 6 is a perspective view of an automatic telescopic pole according to Embodiment 2 of the present invention.
Figure 7:
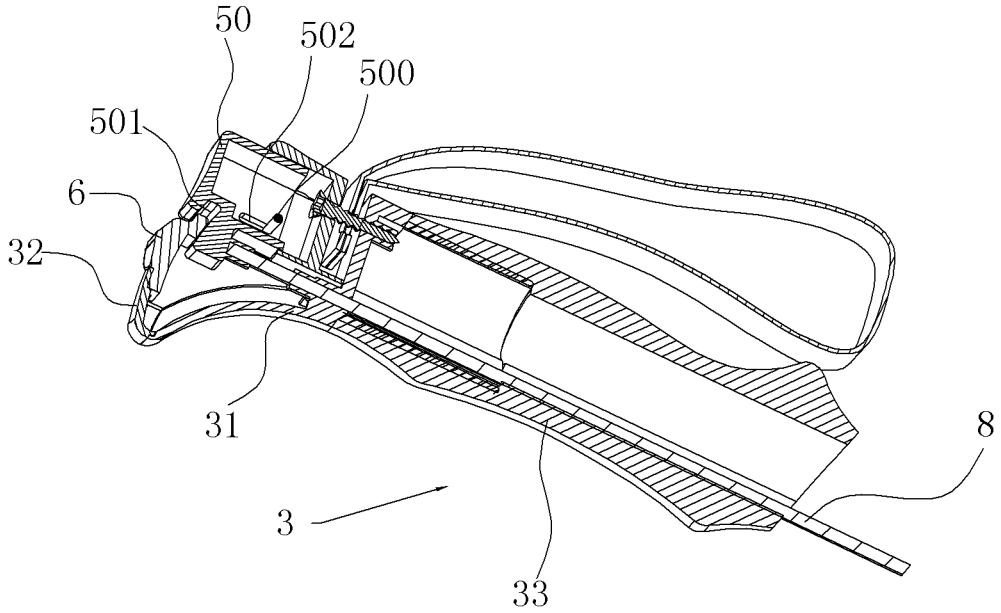
FIG. 7 is a sectional view of a handle of Embodiment 2 of the present invention.
Figure 8:
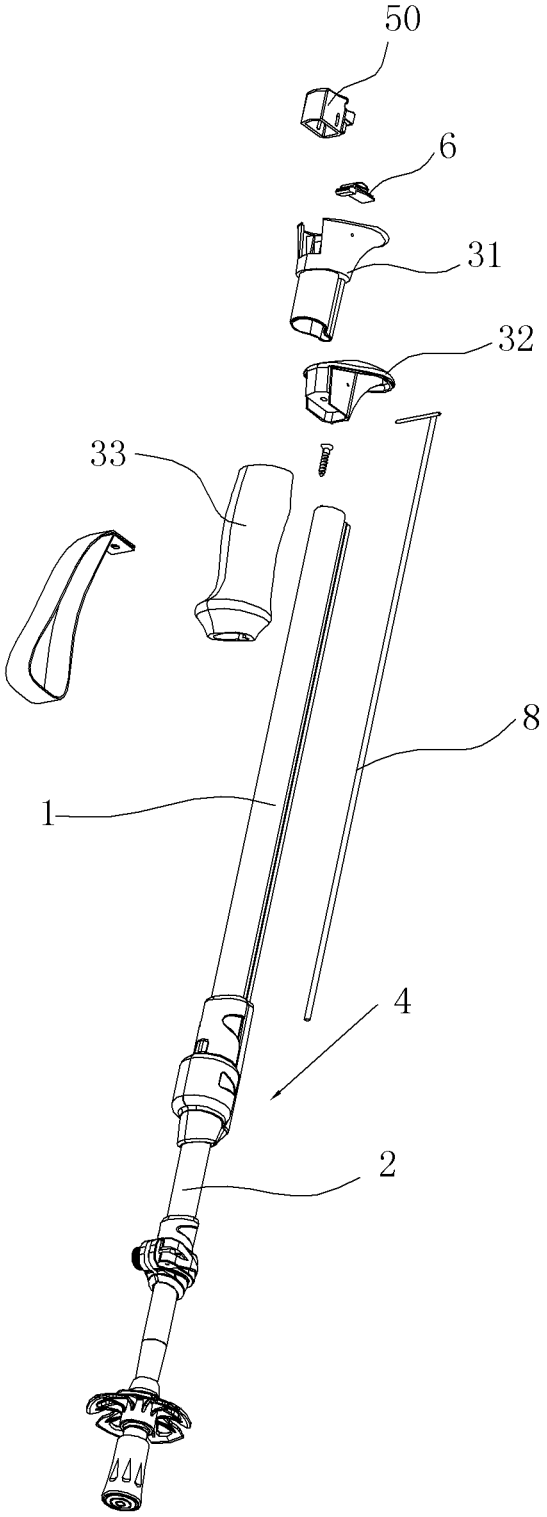
FIG. 8 is an exploded view of the automatic telescopic pole according to Embodiment 2 of the present invention.
Figure 9:
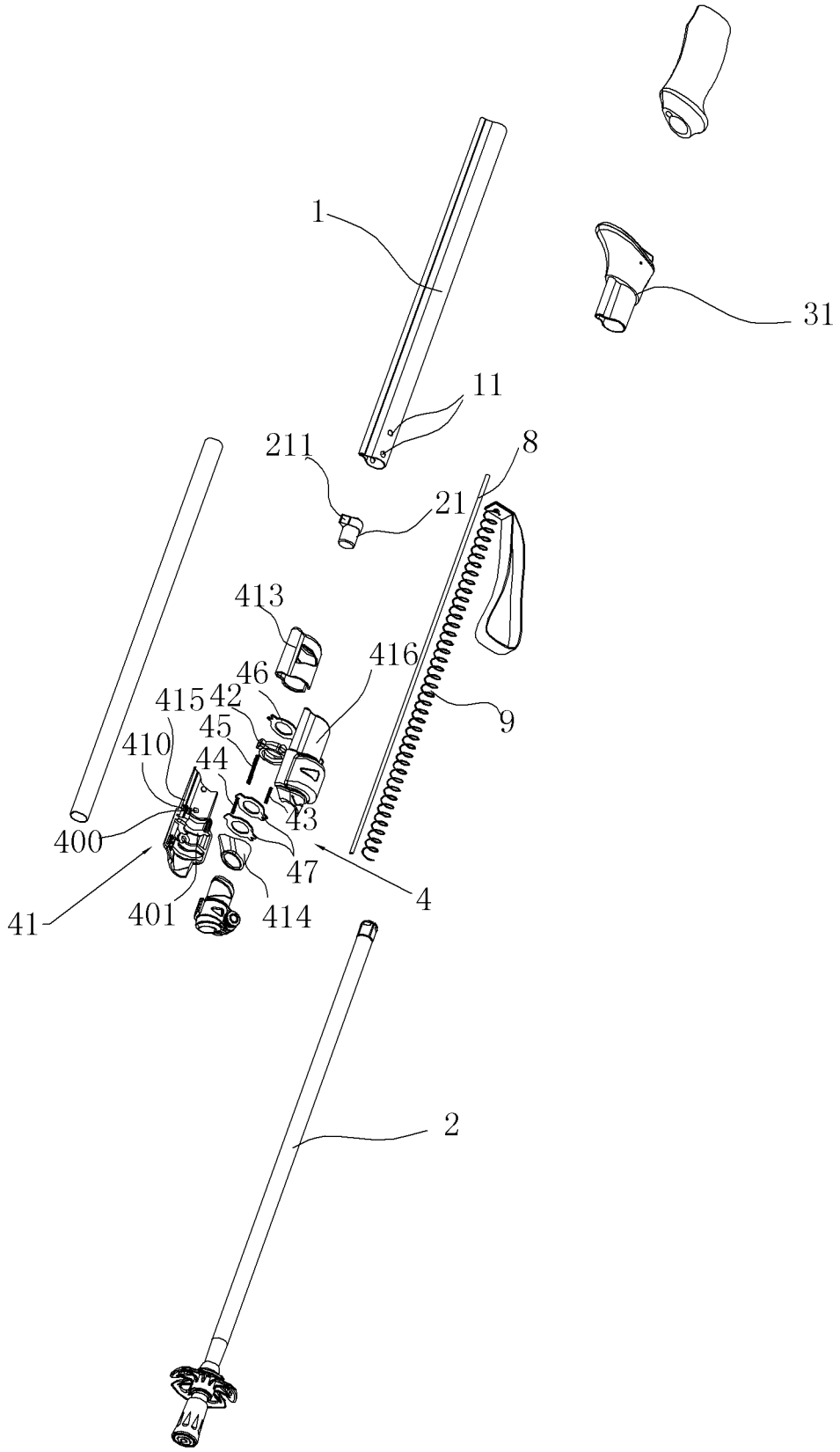
FIG. 9 is an exploded view of the automatic telescopic pole according to Embodiment 1 of the present invention.

As shown in FIGS. 6, 7 and 8, the automatic telescopic pole in this embodiment comprises a first pole section 1, a second pole section 2, a third pole section, a handle 3, as well as a telescoping mechanism and a clasp-type telescopic locking device 4. The difference from Embodiment 1 lies in that the button 5 in Embodiment 1 is a hinged button, while the button 50 in this embodiment is a button that can move up and down. Both buttons provide for the same effect.

Specifically, the button 50 is inserted in the handle body 31 in such a way that the button 50 can move up and down. Guide and limiting holes 502 are formed on two sides of the button 50 in the longitudinal direction, and pins 500 are passed through the guide and limiting holes 502 and then fixed on the handle body 31. An opening, from which the button 50 is protruded, is formed at the upper end of the cover 32. A positioning slide rail, in which the lock catch 6 is arranged in such a way that it can slide therein, is disposed at the front end of the opening. A pressing portion 501, fitted with the lock catch 6 for locking, is formed in the middle of the upper end of the button 50. A third spring, which is resisted against the button 50 to keep the button 50 always in a trend of popping up outward is sheathed on the driving rod 8. A bottom of the button 50 is resisted against the driving rod 8. The driving rod 8 moves downward when the button 50 is pressed down, to drive the clasp-type telescopic locking device 4 to open.

The remaining structure is the same as that in Embodiment 1.

The embodiments disclose preferred implementations of the automatic telescopic pole, the protection scope of the present invention is not limited to each embodiments described in this description. Any changes and replacements made on the basis of the scope of the present invention patent and of the description shall be included in the scope of the present invention patent.

What is claimed is:

1. An automatic telescopic pole, comprising:

a first pole section having an upper end and a lower end;

a second pole section telescopically disposed inside the first pole section;

a handle disposed on the upper end of the first pole section;

an elastic member, keeping the second pole section in a trend of extending outward, and disposed between the second pole section and the first pole section;

a clasp-type telescopic locking device having a clasp used for locking the second pole section, and disposed between the second pole section and the first pole section; and a driving rod having an upper end and a lower end, used for driving the clasp to oscillate, and disposed in the clasp-type telescopic locking device along a longitudinal direction of the first pole section;

wherein, a button mechanism, which has a button and is used for pressing against the upper end of the driving rod to unlock the telescopic locking device, is disposed on the handle; and a lock catch for locking the button is slideably disposed on the handle and in front of the button mechanism.

2. The automatic telescopic pole of claim 1, wherein the handle comprises a handle body and a cover;

the button of the button mechanism has a front end and a rear end, and is disposed on a top end of the handle body;

the front end of the button is hinged with the top end of the handle body;

the cover has an opening at a rear portion of the cover, and a sliding groove at a middle portion of the cover;

the rear end of the button is exposed from the opening of the cover;

the sliding groove is communicated with the opening of the cover, for receiving the lock catch which can slide along the sliding groove;

the button has a pressing recess disposed at a middle of a top portion of the button, and matching with the lock catch for preventing the button from popping upward;

a third spring surrounds around the driving rod, and resists against the button to keep the button in a trend of popping upward;

a middle of a bottom portion of the button is resisted against the driving rod; and the driving rod moves downward when the button is pressed down, to make the clasp-type telescopic locking device to be unlocked.

3. The automatic telescopic pole of claim 2, wherein an upper opening is formed at an upper end of the handle body;

a connecting ear is arranged at a front end of the upper opening, and a pair of connecting holes is formed on the connecting ear;

an axle hole is transversely formed at the front end of the button;

a connecting pin passes through the pair of connecting holes and the axle hole to rotatably connect the button and the handle body together;

a pressing portion, which is protruded from the cover, is formed in the rear portion of the button;

a front side of an upper end of the pressing portion extends forward to form the pressing recess in which the lock catch is inserted for locking; and a rear end of the pressing portion is sheathed on a rear side of the cover in such a way that the rear end is oscillatable up and down.

4. The automatic telescopic pole of claim 1, wherein the handle comprises a handle body having an upper end and a lower end, and a cover having an upper end and a lower end;

the button mechanism is designed in such a way that the button is disposed on the upper end of the handle body;

the button is inserted into the handle body in such a way that the button is movable up and down;

an opening, from which the button is protruded, is formed on the upper end of the cover;

a positioning slide rail, in which the lock catch is disposed and slidable therein, is arranged at a front end of the opening of the cover;

a pressing portion, fitted with the lock catch for locking, is formed in a middle of an upper end of the button;

a third spring, which is resisted against the button to keep the button always in a trend of popping up outward, is sheathed on the driving rod;

a bottom of the button is resisted against the driving rod; and the driving rod moves downward when the button is pressed down, to drive the clasp-type telescopic locking device to open.

5. The automatic telescopic pole of claim 4, wherein a pair of guide and limiting holes are formed on two sides of the button in the longitudinal direction, and pins passes through the pair of guide and limiting holes and then fixed on the handle body.

6. The automatic telescopic pole of claim 4, wherein the lock catch is a bar structure fitted with the positioning slide rail on the cover;

the lock catch is disposed on the positioning slide rail, with a front end of the lock catch being inserted into and clamped in the cover by shift lock fitting, and a rear end of the lock catch extending downward and backward to form a locking portion fitted with the pressing portion on the button for locking.

7. The automatic telescopic pole of claim 6, wherein a shift lock trough is concavely and transversely formed on a front side of an upper end surface of the lock catch;

a corresponding shift lock rib is convexly and transversely formed on an inner wall of the cover; and a jagged oblique bump, which is convenient for pushing by a hand, is formed in a middle of the upper end surface of the lock catch.

8. The automatic telescopic pole of claim 1, wherein the clasp-type telescopic locking device comprises a connecting sleeve, an oscillating ring and a locking clasp;

the connecting sleeve is fixedly sheathed on an outer side of the lower end of the first pole section;

the oscillating ring is disposed, by a connecting pin, in the connecting sleeve at a position below the first pole section, in such a way that the oscillating ring is oscillatable therein;

the locking clasp has an upper clasp and a lower clasp; and the second pole section is inserted in the first pole section by passing through the connecting sleeve, the lower clasp, the oscillating ring and the upper clasp, and the second pole section is locked with and fixed to the connecting sleeve by the locking clasp; and the elastic member is a fourth spring which keeps the second pole section always in a trend of popping up outward.

9. The automatic telescopic pole of claim 8, wherein an annular cavity has an upper end and a lower end, in which the oscillating ring, the upper clasp and the lower clasp are received and is oscillatable therein, is formed in a middle of an inner wall of the connecting sleeve;

a first slot, in which a front end of the upper clasp is inserted and which tilts backward and downward, is formed on a front side of the upper end of the annular cavity;

a second slot, in which a rear end of the lower clasp is inserted and which tilts forward and upward, is formed on a rear side of the lower end of the annular cavity;

the oscillating ring is rotatably disposed between the first slot and the second slot;

a first spring, which is resisted against a rear side of the upper clasp, is longitudinally disposed in the connecting sleeve at a position over the rear side of the upper clasp;

a second spring, which is resisted against a front side of a lower end of the lower clasp, is longitudinally disposed at a position below the front side of the lower clasp;

the upper clasp and the lower clasp are obliquely resisted against one side of the oscillating ring respectively by the first spring and the second spring, and an inner wall of each of the upper clasp and the lower clasp is locked with and fixed to an outer wall of the second pole section;

the driving rod is disposed inside the first pole section, and the lower end of the driving rod is resisted against a front side of an upper end of the oscillating ring by passing through a front side of the upper clasp or directly; and the driving rod moves downward when the button is pressed down, to drive a front side of the oscillating ring to oscillate downward, the upper clasp and the lower clasp become straight against an effect of the first spring and the second spring due to the oscillating ring, to release the locking of the second pole section.

10. The automatic telescopic pole of claim 8, wherein the lower clasp is configured as two lower clasps superimposed together.

11. The automatic telescopic pole of claim 8, wherein a circular channel through which the second pole section passes and a circular hole through which the driving rod passes run through the first pole section;

a guide hole corresponding to the circular hole is formed in the handle; and the upper end of the driving rod resists against the button by passing through the handle.

12. The automatic telescopic pole of claim 11, wherein a shock absorbing spring is longitudinally disposed in the connecting sleeve at a position over a front side of the upper clasp, and the shock absorbing spring is disposed over the upper clasp and in a transition space between the circular channel and the circular hole and is fitted with a guide and limiting block on the second pole section.

13. The automatic telescopic pole of claim 8, wherein the connecting sleeve is divided into a left connecting sleeve and a right connecting sleeve, which are fixedly clamped, by an upper jacket and a lower jacket, on the first pole section after being folded together at the lower end of the first pole section.

14. The automatic telescopic pole of claim 13, wherein two positioning holes are axially formed on left and right sides of the lower end of the first pole section;

corresponding two positioning blocks are convexly disposed on inner walls of upper portions of the left connecting sleeve and the right connecting sleeve; and the left connecting sleeve and the right connecting sleeve are folded together and then positioned at the lower end of the first pole section by fitting of the positioning blocks with the positioning holes and then are fixedly clamped by the upper jacket and the lower jacket.

15. The automatic telescopic pole of claim 14, wherein the upper jacket is a jacket having an open side corresponding to an upper portion of the connecting sleeve, and a transition and connection portion of the first pole section is also a guide portion fitted with the upper jacket.

16. The automatic telescopic pole of claim 13, wherein a shock absorbing spring, which is fitted with a guide and limiting block on the second pole section is longitudinally disposed in the connecting sleeve at a position over a front side of the upper clasp; and a positioning slot, in which a lower end of the shock absorbing spring is inserted, is formed in an upper portion of an annular cavity after the left connecting sleeve and the right connecting sleeve are folded together.

17. The automatic telescopic pole of claim 16, wherein a circular channel through which the second pole section passes and a circular hole through which the driving rod passes run through the first pole section;

the shock absorbing spring is inserted in the positioning slot and in a transition and connection portion between the circular channel and the circular hole; and the guide and limiting block is convexly disposed on a side of a stopper arranged at an upper end of the second pole section, and corresponds to the shock absorbing spring.

18. The automatic telescopic pole of claim 2, wherein a lower end of the handle body is sheathed on the first pole section and fixed to the first pole section by a handle sheath;

a gap, in which a wrist strap is inserted, is formed between a rear side of the handle body and the cover; and a screw passes through the cover and the wrist strap, and screws into the handle body to fix the wrist strap.

* * * * *